US005486047A

United States Patent [19]

Zimmerman

[11] Patent Number: 5,486,047

[45] Date of Patent: Jan. 23, 1996

[54] MIXING AUGER FOR CONCRETE TRUCKS

[76] Inventor: Harold M. Zimmerman, R.D. #1, Wabash Rd., Ephrata, Pa. 17522

[21] Appl. No.: 465,460

[22] Filed: Jun. 5, 1995

[51] Int. Cl.[6] ..... B28C 5/24; B01F 7/08

[52] U.S. Cl. ..... 366/50; 366/68; 366/186; 366/196; 198/860.3

[58] Field of Search ..... 360/50, 51, 64, 360/68, 186, 194, 195, 196, 318, 320, 321, 319; 198/657, 675, 676, 860.3, 861.1; 414/526

[56] References Cited

U.S. PATENT DOCUMENTS

| | | | |
|---|---|---|---|
| 3,310,293 | 3/1967 | Zimmerman | 366/6 |
| 4,403,864 | 9/1983 | Stastny | 366/19 |
| 4,406,548 | 9/1983 | Haws | 366/8 |
| 4,441,821 | 4/1984 | Burkhart | 366/61 |
| 4,551,024 | 11/1985 | Clapp | 366/50 |
| 4,586,824 | 5/1986 | Haws | 366/34 |
| 5,354,127 | 10/1994 | Zotto | 366/50 |

*Primary Examiner*—Robert W. Jenkins

[57] ABSTRACT

A mixing auger apparatus for an on-site mobile concrete mixer is disclosed wherein the mixing auger apparatus is capable of effective operation while oriented at an angle of inclination greater than 22° to the horizontal. The mixing auger apparatus is provided with a flexible housing that extends around the entire circumference of a half flight auger. The flexible housing is suspended from a frame such that the housing is flexible completely around the mixing auger. Adjustment devices allow the positional movement of the flexible housing relative to the mixing auger to modify the clearance between therebetween. The flexible housing is separable to permit movement thereof into an inoperable position to facilitate a cleanout of the mixing auger apparatus. The deployment of the mixing auger apparatus on a mobile concrete mixer permits the use of a standard gravity fed conveying apparatus to deliver component materials to a lower portion of the vehicle with the discharge of a concrete mixture into an elevated chute mechanism which is operable to place the mixture forwardly of the vehicle along a variable range of operation. The mixing auger apparatus is also pivotally supported to provide a range of operation laterally of the vehicle independently of the chute mechanism.

20 Claims, 6 Drawing Sheets

MIXING AUGER FOR CONCRETE TRUCKS

BACKGROUND OF THE INVENTION

This invention relates generally to mobile machines for mixing concrete on-site, and more particularly, to a mixing auger apparatus for use on concrete trucks.

Concrete trucks, such as that described in U.S. Pat. No. 3,310,293, issued to Harold M. Zimmerman on Mar. 21, 1967, and U.S. Pat. No. 4,406,548, issued to Paul M. Haws on Sep. 27, 1983, carry supplies, such as aggregate, cement and water, in discrete hoppers from which the supplies are drawn in predetermined ratios to be deposited in a mixing auger apparatus where the combined supplies are mixed and turned into concrete to be discharged from the mixing auger externally of the concrete truck. This mixing auger apparatus is formed from a generally semi-circular flexible housing against which a standard pitch, spiral flighted auger works to not only mix the combined supplies, but to convey the combined supplies, and ultimately the created concrete, to the remote discharge end of the auger.

This mixing auger apparatus was limited in use to a maximum vertical angle of inclination of approximately 22° from horizontal. If the mixing auger were inclined at an angle greater than approximately 22°, the water and/or other liquid supplies would not be properly conveyed by the standard flight auger along the semi-circular housing, preventing the combined supplies from properly mixing to create concrete. Typically, the liquid supplies would "splash back" over top of the mixing auger, rather than be conveyed upwardly toward the discharge end of the auger.

It is known in the auger arts that the use of a half pitch auger, i.e. an auger whose axial spacing of flighting is generally equal to half the diameter of the auger flighting, as opposed to a standard pitch auger whose axial spacing of flighting is approximately equal to the diameter of the auger flighting, will improve the ability to convey liquid materials upwardly over vertical inclinations greater than 22°. The use of a flexible housing to cooperate with the auger flighting allows the mixing auger apparatus to convey conventional sized aggregate used to create concrete without either becoming pulverized by the action of the auger or damaging the auger by becoming wedged between the flighting and the housing.

Conventional concrete mixers have utilized a drum mounted on a truck frame to deliver mixed concrete to a delivery site by discharging the mixed concrete from the elevated, rearwardly directed, central discharge opening of the drum. More recent variations of the conventional concrete mixers have reoriented the drum to position the discharge opening toward the front of the truck, which enables the operator to control the discharge and delivery of the mixed concrete through a front-mounted discharge chute mechanism without leaving the cab of the truck.

Concrete trucks, as described in the aforementioned U.S. Pat. Nos. 3,310,293 and 4,406,548, located the mixing auger apparatus at the rear of the truck to receive the respective supplies fed downwardly and rearwardly thereto. The upward incline of the mixing auger allowed the mixed concrete to be discharged from a slightly elevated position to be delivered through a cooperative discharge chute mechanism. A mere repositioning of the mixing auger apparatus to the front of the truck to enable the forward discharge of the mixed concrete forwardly thereof is not a simple design choice as the operator's cab of the truck prevents the relocation of the mixing auger apparatus to the opposing front position. The forwardly delivering concrete truck must be capable of delivering mixed concrete at a forward position above the cab of the truck so that a discharge chute mechanism, which must be storable in a transport position above the truck cab out of the line of sight of the operator, can deliver the mixed concrete to the ground forwardly of the truck.

Accordingly, it would be desirable to provide a concrete machine operable to mix supplies of materials on-site that would be capable of discharging the mixed concrete forwardly of the concrete truck. It would be further desirable to provide a mixing auger apparatus that would be operable to combine supplies of materials needed to create concrete and delivered thereto, and be able to convey the combining materials along the length of the mixing auger even though the mixing auger is inclined at an angle greater than 22° to the horizontal, which would enable the discharge of mixed concrete therefrom at a position elevated above the cab of the concrete truck. It would also be desirable to provide an adjustment apparatus to compensate for wear between the mixing auger and the flexible housing so that the mixing auger apparatus can be efficiently operated at an angle greater than 22° for a greater life.

SUMMARY OF THE INVENTION

It is an object of this invention to overcome the aforementioned disadvantages of the prior art by providing a mixing auger apparatus for use on a mobile concrete producing machine that is operable to mix preselected supplies of materials to create concrete while inclined at an angle greater than 22° to the horizontal.

It is another object of this invention to provide a mixing auger apparatus that is capable of conveying a concrete mixture upwardly at an angle of inclination greater than 22°.

It is a feature of this invention that the mixing auger apparatus is constructed with a flexible housing circumferentially surrounding the mixing auger rotatably supported therewithin.

It is an advantage of this invention that the flexible housing enclosure enables both concrete aggregate and liquid materials to be conveyed along the length of the mixing auger apparatus irrespective of the angle of inclination thereof.

It is another feature of this invention that the rotatably supported auger within the mixing auger apparatus is formed with half pitch flighting to facilitate the conveying of liquid materials therewithin.

It is another advantage of this invention that the angle of inclination of the mixing auger apparatus is no longer a critical limitation relating to the operation thereof in the production of a concrete mixture therein.

It is still another object of this invention to provide a mixing auger apparatus that can be utilized on a mobile concrete production vehicle to mix preselected supplies of component materials to create a concrete mixture to be discharged therefrom at a location elevated above the operator's cab of the vehicle.

It is still another advantage of this invention that the mixing auger can be utilized to discharge a concrete mixture therefrom into a discharge chute mechanism for selectively delivering the concrete mixture forwardly of the operator's cab of the vehicle.

It is yet another advantage of this invention that the mixing auger can be oriented to receive preselected supplies of materials delivered in part by gravity to a lower position on the vehicle and discharge a concrete mixture to a chute mechanism mounted at an elevated position above the vehicle cab.

It is still another feature of this invention that the top of the flexible housing circumferentially encircling the mixing auger is movable into an inoperable position to facilitate a cleanout of the mixing auger apparatus.

It is yet another feature of this invention that the flexible housing for the mixing auger apparatus is suspended from a frame such that the housing is flexible completely around the mixing auger.

It is yet another object of this invention to provide a mixing auger apparatus for a concrete production machine which is durable in construction, inexpensive of manufacture, carefree of maintenance, facile in assemblage, and simple and effective in use.

It is a further object of this invention to provide a mobile concrete production machine that is operable to deliver a concrete mixture along a range of operation heretofore unknown.

It is a further feature of this invention that the mixing auger apparatus is pivotally mounted on a mobile concrete production machine to deliver a concrete mixture selectively along a first range of operation laterally of the concrete production machine and to a front-mounted discharge chute mechanism.

It is still a further feature of this invention that the front mounted discharge chute mechanism is operable to deliver a concrete mixture along a second range of operation extending generally forwardly of the concrete production machine.

It is yet another advantage of this invention that the second range of operation extends along an arc greater than 180°.

It is yet a further object of this invention to provide an adjustment mechanism operable to maintain a critical clearance between the mixing auger and the flexible housing even after the relative parts have worn.

It is a further advantage that the mixing auger apparatus can be adjusted to maintain a critical clearance between the mixing auger and the flexible housing to allow the mixing auger apparatus to be operated at an angle greater than 22° to horizontal for a longer life.

It is yet a further feature of this invention to provide positional adjustment devices to move the flexible housing relative to the mixing auger to maintain a critical clearance therebetween.

It is still a further object of this invention to provide a mobile on-site concrete mixer which is durable in construction, inexpensive of manufacture, carefree of maintenance, facile in assemblage, and simple and effective in use.

These and other objects, features and advantages are accomplished according to the instant invention by providing a mixing auger apparatus for an on-site mobile concrete mixer that is capable of effective operation while oriented at an angle of inclination greater than 22° to the horizontal. The mixing auger apparatus is provided with a flexible housing that extends around the entire circumference of a half flight auger. The flexible housing is suspended from a frame such that the housing is flexible completely around the mixing auger. Adjustment devices allow the positional movement of the flexible housing relative to the mixing auger to modify the clearance between therebetween. The flexible housing is separable to permit movement thereof into an inoperable position to facilitate a cleanout of the mixing auger apparatus. The deployment of the mixing auger apparatus on a mobile concrete mixer permits the use of a standard gravity fed conveying apparatus to deliver component materials to a lower portion of the vehicle with the discharge of a concrete mixture into an elevated chute mechanism which is operable to place the mixture forwardly of the vehicle along a variable range of operation. The mixing auger apparatus is also pivotally supported to provide a range of operation laterally of the vehicle independently of the chute mechanism.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
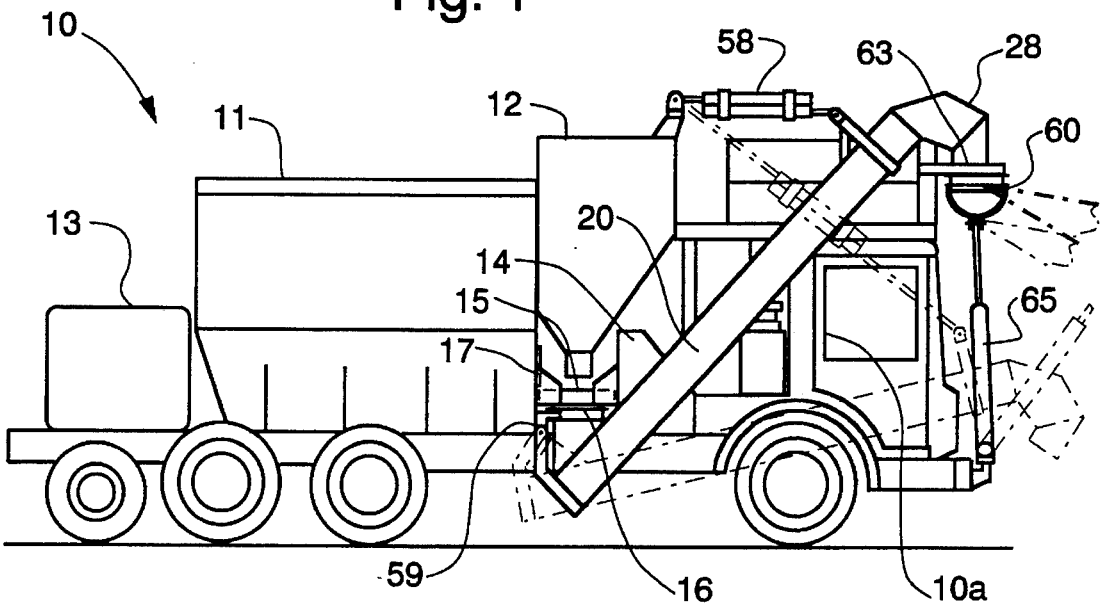
FIG. 1 is a side elevational view of a mobile concrete mixer incorporating the principles of the instant invention, the movements of the mixing auger apparatus and the discharge chute mechanism being shown in phantom.

Referring now to the drawings and, particularly, to FIG. 1, a representative side elevational view of a mobile concrete mixer incorporating the principles of the instant invention can best be seen. Left and right references are used as a matter of convenience and are determined by standing at the rear of the concrete mixer and facing the forward end, where the operator's cab is positioned, in the normal direction of travel. The mobile concrete mixer 10 is of the type carrying segregated supplies of component materials for the production of concrete, including aggregate in a first hopper 11, cement in a second hopper 12, water in a third hopper 13, and additives in a fourth hopper 14, which are delivered by a conventional chain and slat conveying mechanism 15 to a mixing auger apparatus 20 in preselected proportions for the on-site production of a concrete mixture. The general details of the operation of an on-site concrete mixer 10 can be found in U.S. Pat. No. 3,310,293, issued to Harold M. Zimmerman on Mar. 21, 1967, the description portions of which are incorporated herein by reference.

Figure 2:
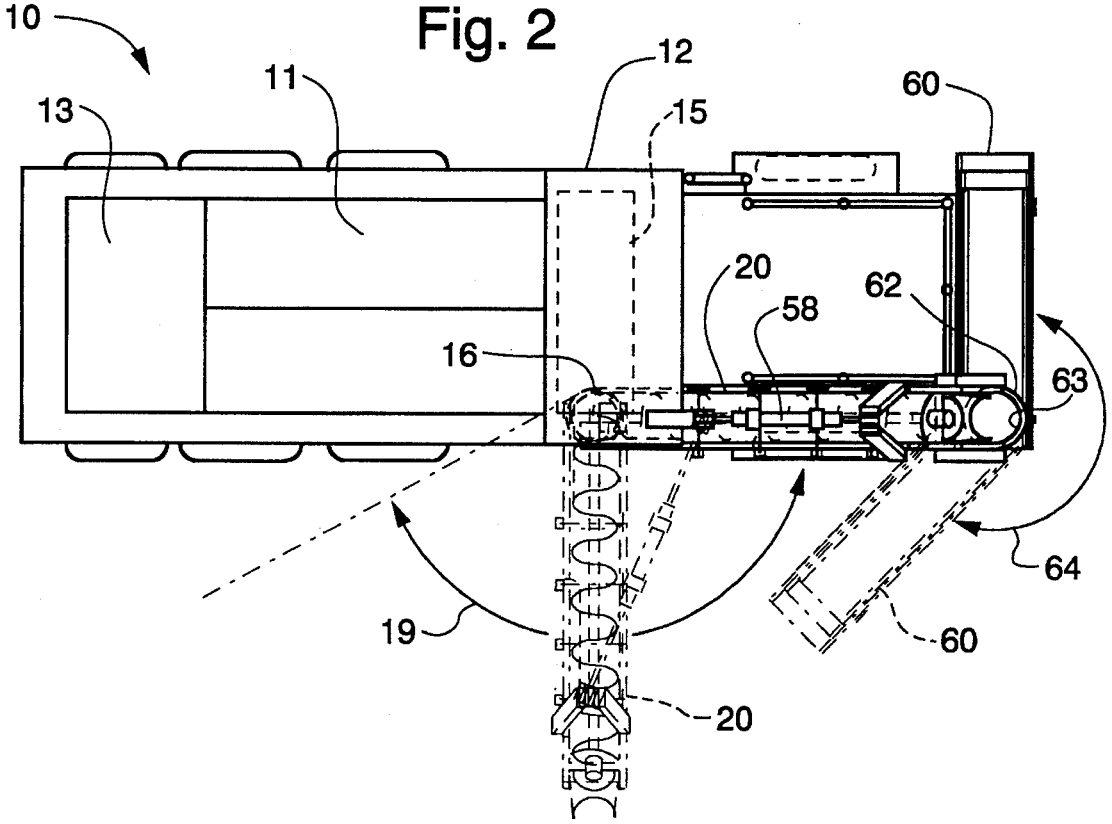
FIG. 2 is a top plan view of the mobile concrete mixer shown in FIG. 1, the movements of the mixing auger apparatus and the discharge chute mechanism being shown in phantom.

The conveyor mechanism 15 delivers the component materials to a receiving ring 16 pivotally supporting the mixing auger apparatus 20 at a lateral side of the vehicle 10. The receiving ring 16 includes a fixed shroud 17 that funnels the component materials into the infeed opening 21 of the mixing auger apparatus 20. The receiving ring is rotatable in a known manner to permit rotational movement of the mixing auger apparatus 20 from a first operative position shown in solid lines in FIGS. 1 and 2 through a range of operation laterally of the vehicle 10 as indicated by the arrow 19. In the normal, first operative position, the mixing auger apparatus 20 is operable to discharge a concrete mixture into a discharge chute mechanism 50 for purposes to be described in greater detail below.

The angle of repose of the mixing auger apparatus 20 when in the normal, first operative position greatly exceeds an angle of 22° as measured from horizontal, which has been know to be a limiting factor in the operation of the prior art mixing auger mechanisms, such as described in the aforementioned U.S. Pat. No. 3,310,293. To enable the mixing auger apparatus 20 to convey the fluid concrete mixture formed from the individual component materials fed into the infeed opening 21, the mixing auger apparatus 20 is constructed with a mixing auger 22 cooperable with a flexible housing 30 extending circumferentially around the mixing auger 22.

Figure 3:
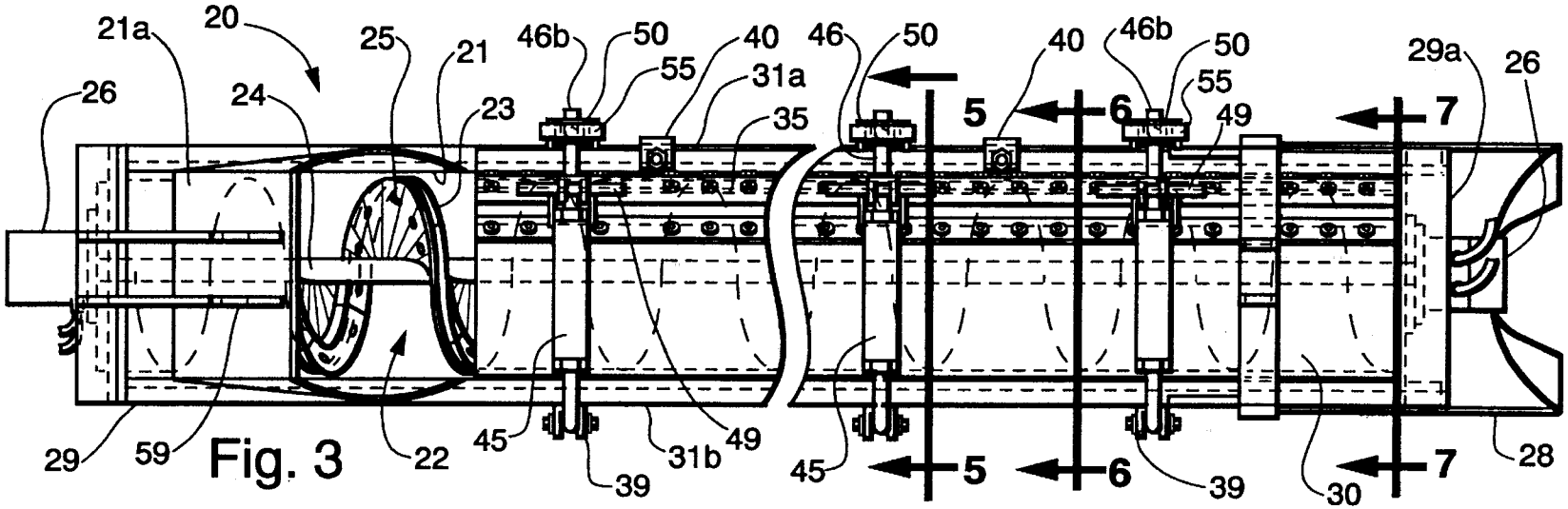
FIG. 3 is a top plan view of the mixing auger apparatus forming a part of the mobile concrete mixer shown in FIGS. 1 and 2, a central portion of the mixing auger apparatus being broken away for purposes of clarity.
Figure 4:
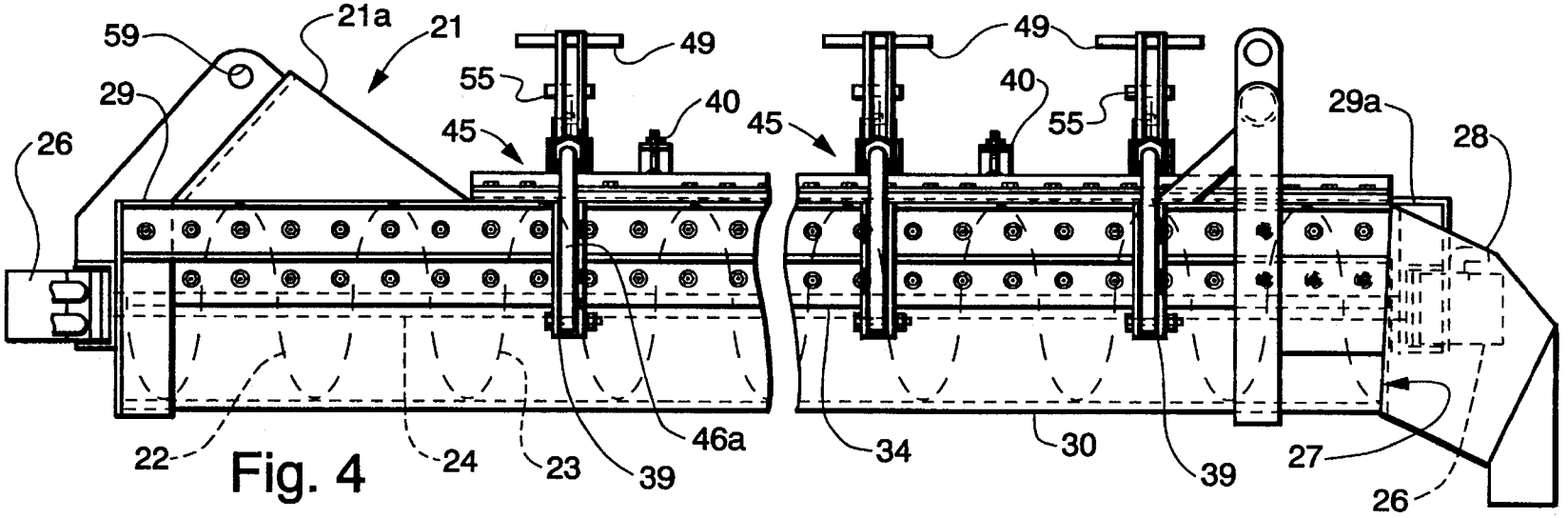
FIG. 4 is a side elevational view of the mixing auger apparatus shown in FIG. 3, a central portion of which is broken away for the purposes of clarity.

Referring now to FIGS. 3 and 4, one skilled in the art can readily see that the mixing auger 22 is formed with a half-pitch spiral flighting 23 wrapped around a central shaft 24 at a frequency defining a spacing equal to half the diameter of the mixing auger 22. Because of the aggressive contact with aggregate and other of the potentially damaging component materials being fed thereto, the flighting 23 is provided with wear plates 25 individually bolted to the flighting to extend the operative life thereof. The mixing auger 22 is rotatably supported by bearings mounted in the subframe 29 at each opposing end of the mixing auger 22 and is preferably rotatably driven by a pair of co-acting hydraulic motors 26 positioned at the respective ends of the mixing auger 22, as opposed to providing a single large hydraulic motor which would be less cost effective.

Figure 8:
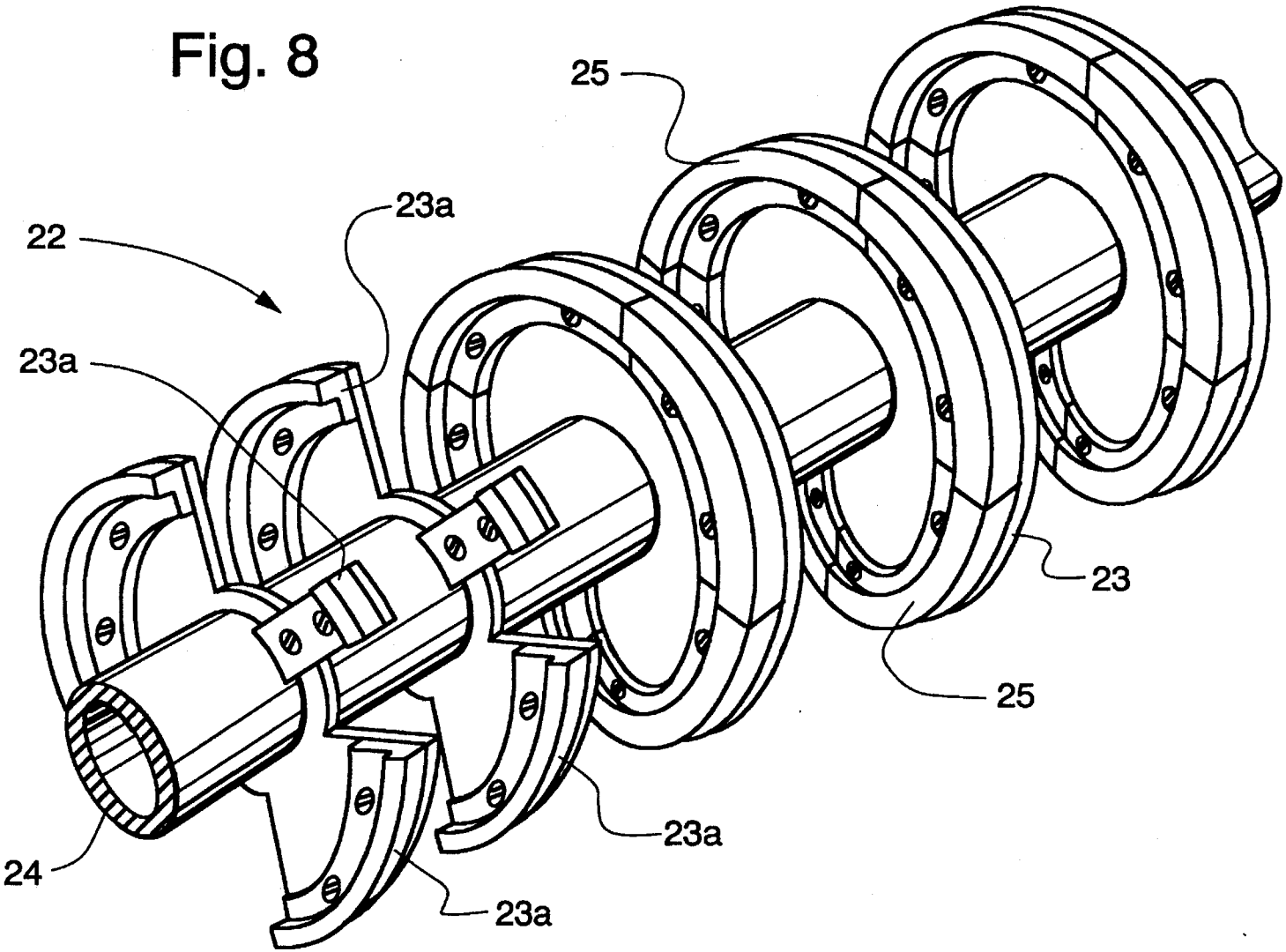
FIG. 8 is a perspective detail view of the discharge end of the mixing auger to depict the segmented auger sections thereof.

The spiral flighting, as best seen in FIG. 8, is formed in an interrupted or broken configuration by individual flighting members **23*a* at the distal discharge end thereof to assure that the respective individual component materials are homogeneously mixed before being extruded out the discharge opening 27 into a discharge shroud 28 at the end of the mixing auger apparatus 22 as a concrete mixture. The hydraulic motor 26 at the distal discharge end of the mixing auger 22 is supported by an end cap 29*a* forming a part of the subframe 29 and covering the end of the chamber formed by the flexible housing 30 below the central auger shaft 24, such that the discharge opening 27 amounts to an open face of the chamber formed by the flexible housing 30 below the end cap 29*a***.

Referring now to FIGS. 2 through 7, the details of the flexible housing 30 can best be seen. The subframe 29 of the mixing auger apparatus 20 not only supports the bearings 26 at the opposing ends of the apparatus 20, but also extend along the length of the mixing auger apparatus 20 to support the flexible housing 30. The provision of the flexible housing 30 to be cooperable with the half-pitch mixing auger 22 enables the housing 30 to have some relief in the event some aggregate slips between the auger flighting 23 and the housing 30. The use of a partial flexible housing is known in the art, as demonstrated in the aforementioned U.S. Pat. No. 3,310,293; however, the provision of a flexible housing 30 extending entirely around the circumference of the mixing auger 22 is heretofore unknown.

Figure 5:
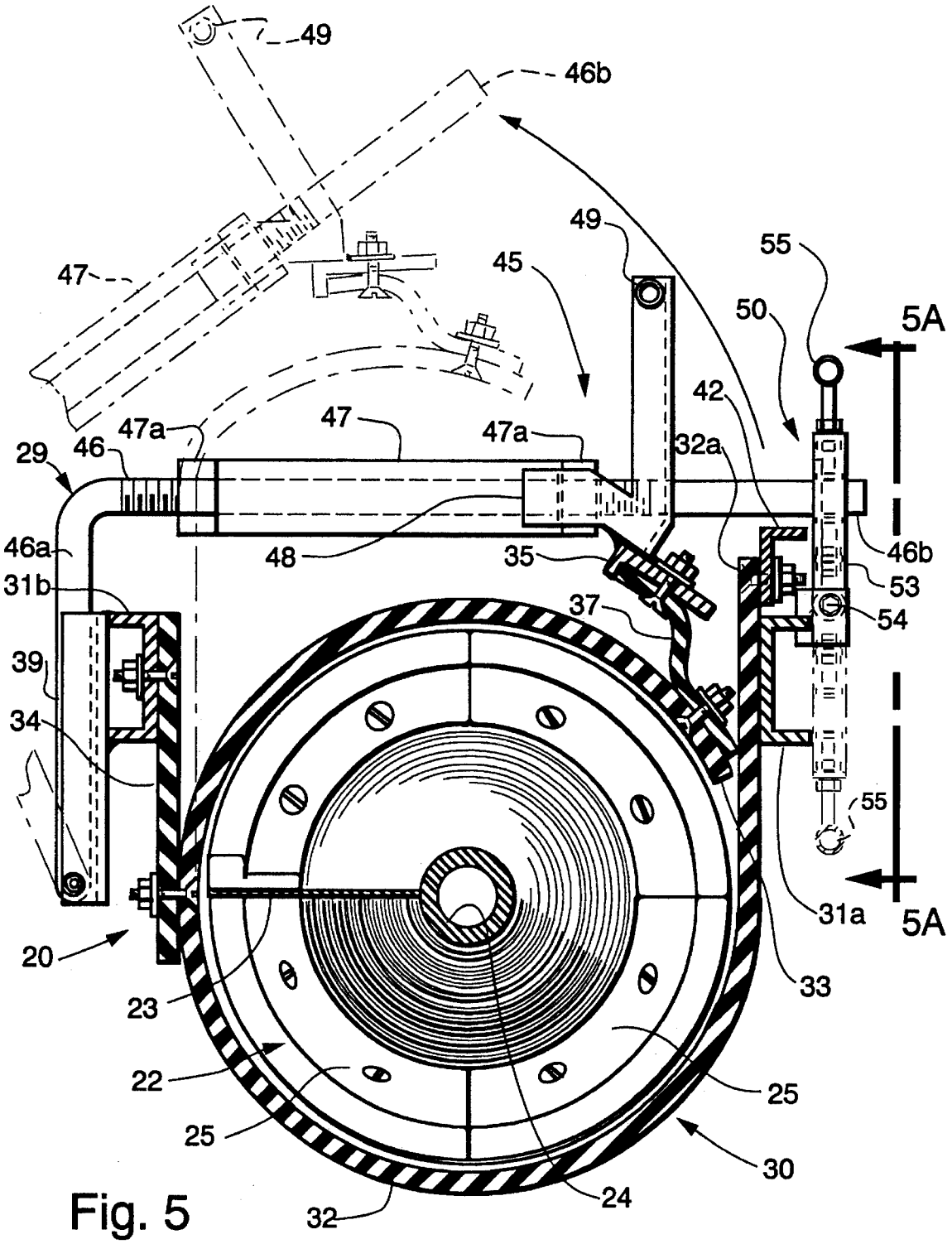
FIG. 5 is a cross sectional view of the mixing auger apparatus corresponding to lines 5—5 of FIG. 3, the movement of the hinged support frame opening the mixing auger apparatus for cleaning being shown in phantom, the pivotal movement of the clamping mechanism also being shown in phantom.
Figure 6:
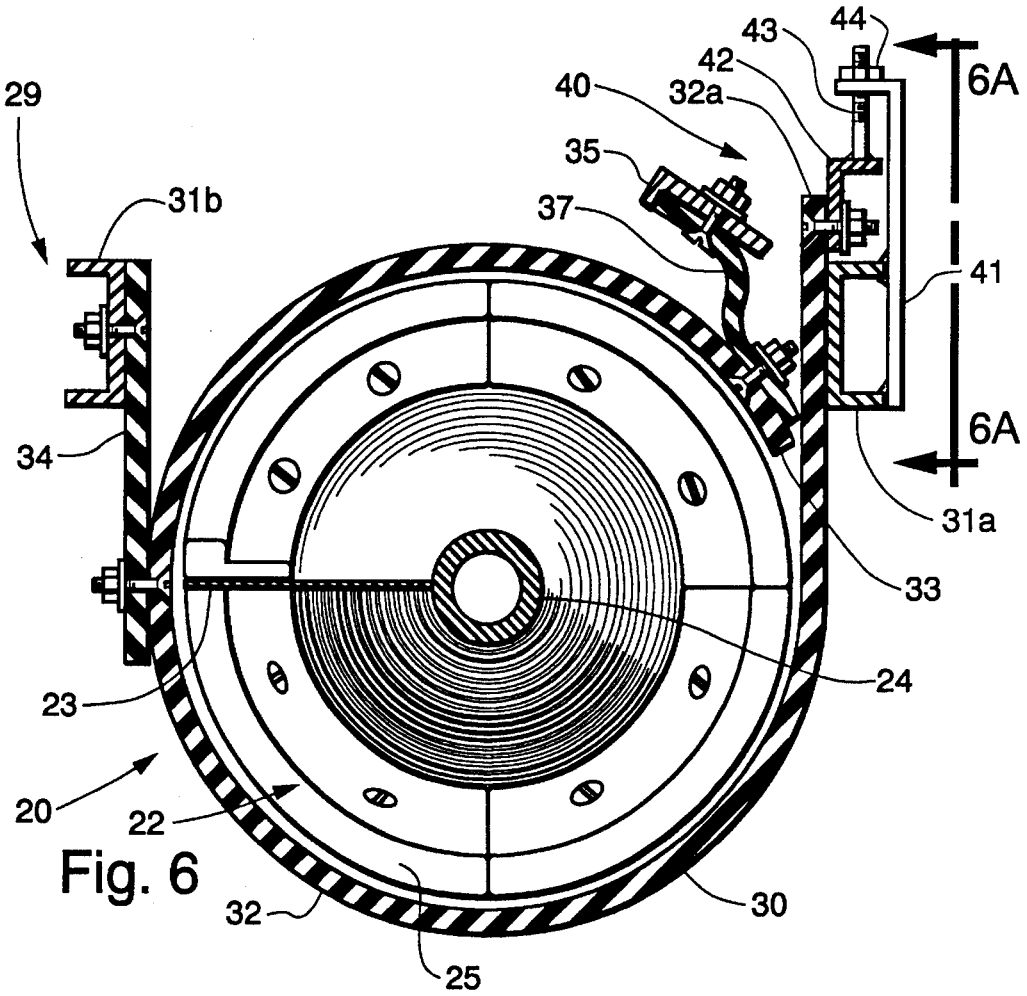
FIG. 6 is a cross sectional view of the mixing auger apparatus corresponding to lines 6—6 of FIG. 3, the background hinged support mechanism being deleted for purposes of clarity.

As best seen in FIGS. 5 and 6, the longitudinally extending beams **31*a*, 31*b* of the subframe 29 support the flexible housing 30, which is preferably formed from a unitary sheet of relatively firm, reinforced elastomeric material 32. One of the transversely spaced beams 31*a* supports a first adjustment mechanism 40 connected by fasteners to a first edge 32*a* of the sheet of material 32 forming the housing 30, which extends downwardly therefrom and wraps around the outer circumference of the mixing auger 22 as defined by the edge of the flighting 23. The opposing longitudinally extending beam 31*b* is connected to a first mounting strip 34 by fasteners that extends downwardly therefrom to be connected by fasteners directly to the sheet of material 32 forming the flexible housing 30**.

The sheet of material 32 continues wrapping around the circumference of the mixing auger 22 from the support provided by the connection thereof to the first mounting strip 34 of the same elastomeric material as the sheet 32 until engaging the free end 33 of itself below the support thereof against the first beam **31*a*, thereby providing a complete 360° enclosure around the mixing auger 22. The rotation of the mixing auger 22 is clockwise as viewed in FIG. 5 to keep the sweeping of the flighting 23 downwardly over the free end 33 so that concrete mixture is not forced upwardly between the free end 33 and the adjacent body portion of the sheet of material 32**.

The free end 33 of the sheet of material 32 is connected to a longitudinally extending support beam 35 through a second mounting strip 37 of the same elastomeric material as the sheet 32 that is connected by fasteners to the sheet 32 in such as manner as to wedge the free end 33 against the adjacent body portion of the sheet of material 32. To locate the free end 33 at the proper location against the sheet of material 32, the support beam 35 is connected either by welding or by detachable fasteners (not shown) to a second adjustment mechanism 45 which serves to fix the free end 33 in an appropriate position with respect to the circumference of the mixing auger 22.

The second adjustment mechanism 45 extends transversely relative to the mixing auger 22 and with the third adjustment feature **50*a* incorporated into the clamping mechanism 50 provide an adjustment for the top clearance of the flexible housing 30. One skilled in the art will readily realize that the flexible housing 30 is yieldable entirely around the circumference of the mixing auger 22 to provide radial relief for any aggregate becoming lodged therebetween, as no rigid support is located adjacent the mixing auger 22**.

The free end 33 is movable away from the longitudinal beam **31*a* to expose the top of the mixing auger 22 to facilitate the cleaning thereof after the production of a concrete mixture is completed. As best seen in FIGS. 3–7, the mixing auger apparatus 20 is provided with a plurality of, preferably about four, longitudinally spaced clamping mechanism 50 that fix the flexible housing 30 into position during normal operation of the apparatus 20. The details of the clamping mechanism 50** are set forth in greater detail below.

Figure 6A:
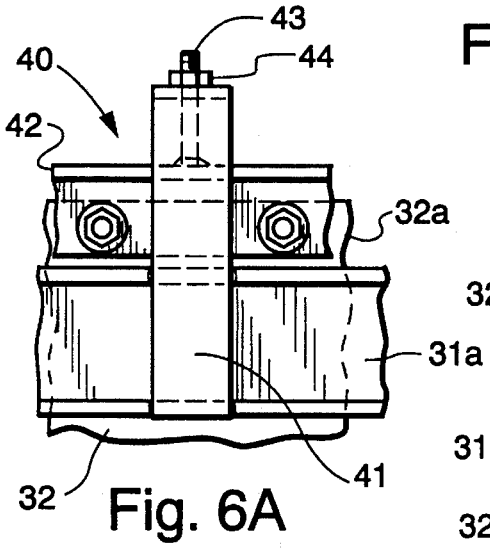
FIG. 6A is a side elevational detail view of the lower clearance adjustment mechanism corresponding to lines 6A—6A of FIG. 6.

In instances where substantial wear is encountered by the mixing auger apparatus 20, it is desirable to provide an adequate mechanism 40, 45 and 50*a* for the positional adjustment thereof. As best seen in FIGS. 6 and 6A, the first adjustment mechanism 40 includes a support member 41 fixed to the longitudinal support beam 31*a* and extending upwardly therefrom. A longitudinally extending angle member 42 is connected by fasteners to the first edge 32*a* of the sheet of material 32 forming the flexible housing 30. A threaded member 43 is connected to the angle member 42 and extends upwardly therefrom to engage the support member 41. A lock nut 44 threadably engages the threaded member 43 and positionally fixes the angle member 42 relative to the support member 41. To close the clearance at the bottom of the apparatus 20 between the mixing auger 22 and the flexible housing 30, the lock nut 44 can be rotated on the threaded member 43 to raise the angle member 42 relative to the support member 41 and, thereby, raise the first edge 32*a* of the sheet of material 32. A plurality, preferably six to eight, of the first adjustment mechanism 40 are longitudinally spaced along the length of the mixing auger apparatus 20.

Further adjustment of the clearance of the flexible housing 30 relative to the mixing auger 22 can be obtained through manipulation of the second adjustment mechanism 45 extending transversely of the mixing auger apparatus 20. The second adjustment mechanism 45 includes a threaded rod 46 extending generally transversely of and above the mixing auger 22. The threaded rod 46 is also provide with a downwardly depending leg 46*a* pivotally connected to the bracket 39 affixed to the longitudinally extending support beam 31*b*. A plurality, preferably four to six, second adjustment mechanisms 45 are longitudinally spaced along the length of the mixing auger apparatus 20, preferably interspaced between the first adjustment mechanisms 40.

The threaded rod 46 has an enlarged tubular sleeve member 47 supported thereon so as to be translatable across the transverse length of the threaded rod 46. A pair of jam nuts 47*a* are threaded on the rod 46 and capture the sleeve member 47 on the rod 46. The tubular sleeve member 47 mounts a support bracket 48 by means of fasteners (not shown) or by welding. The support beam 35 is affixed to the bracket 48 and is, therefore, transversely translatable with the movement of the tubular sleeve member 47 along the threaded rod 46. By manipulating the position of the tubular sleeve member 47 relative to the threaded rod 46 along which the tubular sleeve member 47 is translatable, the position of the free end 33 of the sheet of material 32 can be adjusted relative to the mixing auger 22 and, therefore, adjust the clearance spacing between the housing 30 and the mixing auger 22 at the top of the apparatus 20.

To facilitate the raising of the free end 33 and the support beam 35, the mixing auger apparatus 30 is provided with a plurality of longitudinally spaced lift handles 49 connected to the bracket 48, and thereby also to the rigid support beam 35. The lift handles 49 are pivotally supported from a bracket 39 affixed to the opposing longitudinal beam 31*b*. Whenever the clamping members 50, as will be described in greater detail below, are disengaged from the threaded rod 46, the lifting handles 49 can be manually raised to move the free end 33 away from the mixing auger 22, through a pivotal movement of the leg member 46*a*, and expose the top thereof. As an alternative, the pivotal movement of the threaded rod 46 and the lifting handles 49 could be powered by a hydraulic cylinder or other similar devices.

Figure 5A:
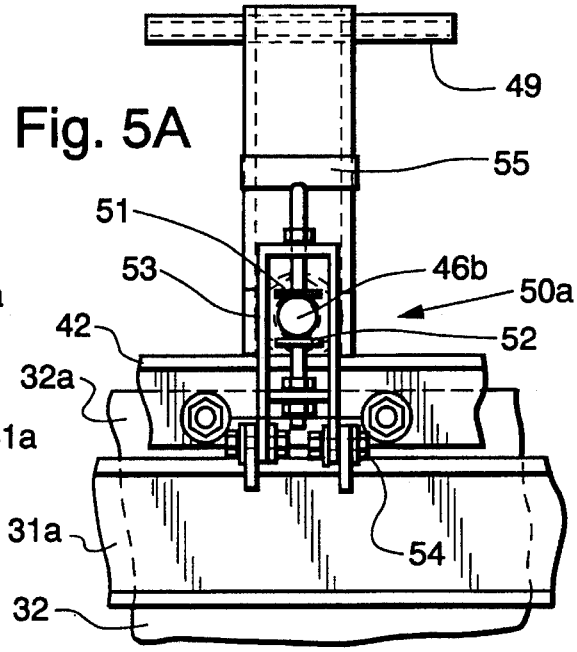
FIG. 5A is a side elevational detail view of the clamping mechanism corresponding to lines 5A—5A in FIG. 5.
Figure 7:
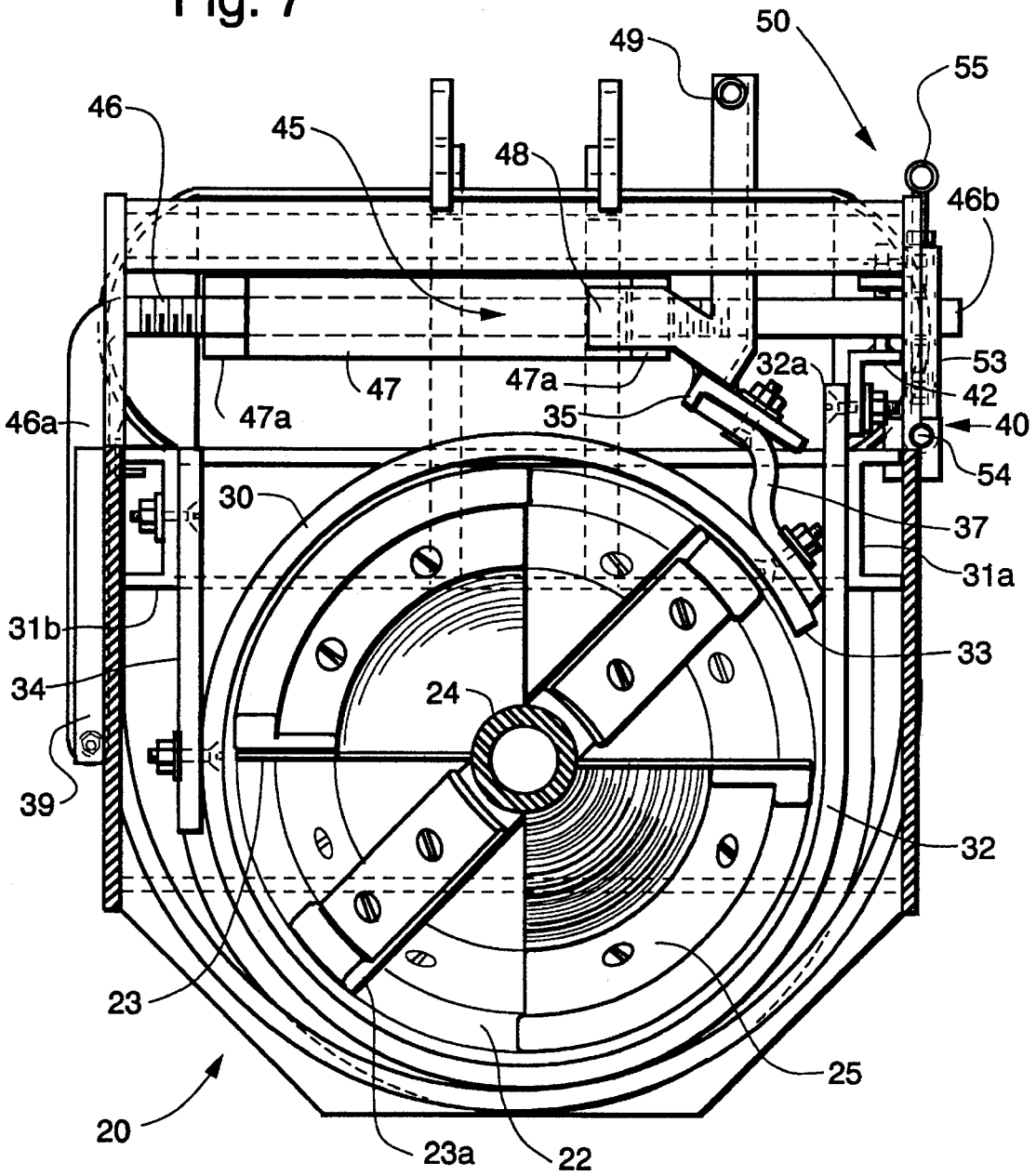
FIG. 7 is a cross sectional view of the mixing auger apparatus corresponding to lines 7—7 of FIG. 3 depicting the discharge end of the mixing auger.

As best seen in FIGS. 5 and 5A, further positional adjustment of the flexible housing 30 can be provided through the third adjustment feature 50*a* forming a part of the clamping members 50. The distal end 46*b* of each of the threaded rods 46 can be captured by a corresponding clamping member 50 each of which includes an upper adjustable ledger 51 and an opposing lower adjustable ledger 52 threadably mounted in a bracket 53 pivotally connected to the longitudinally extending beam 31*a* for pivotal movement about a longitudinally extending pivot axis 54. The upper adjustable ledger 51 is provided with an upwardly extending T-handle 55 for manually manipulating the rotation of the threaded upper ledger 51 to release the clamping of the distal end 46*b* of the threaded rod 46.

The lower adjustable ledger 52 can be positionally lowered to adjust the vertical elevation of the distal end 46*b* of the threaded rod 46 when clamped between the ledgers 51, 52. Since the free end 33 of the flexible housing 30 is supported from the threaded rod 46 through the bracket 48 and the support beam 35, the lowering of the clamped elevation of the distal end 46*b* of the threaded rod 46 affects the relative position of the free end 33 relative to the beam 31*a* and, therefore, the clearance at the top of the mixing auger apparatus 20 between the auger 22 and the flexible housing 30. As depicted in phantom in FIG. 5, the disengaged clamping member 50 can swing downwardly about the pivot axis 54 to allow the raising of the upper portion of the flexible housing 30 for access into the mixing auger apparatus 20.

In operation, the pre-selected quantities of component materials are fed simultaneously into the fixed shroud 17 to be funneled into the infeed opening 21 of the mixing auger apparatus 20. The powered rotation of the mixing auger 22 mixes the component materials, particularly by the interrupted, broken flighting adjacent the distal discharge opening 27, such that a homogeneous concrete mixture is discharged through the discharge opening 27 into the discharge shroud 28. When in the normal operative position, the discharge shroud 28 directs the concrete mixture into a receiving hopper 62 of the discharge chute mechanism 60, which is positioned along the same lateral side of the vehicle 10 as the mixing auger apparatus 20.

The receiving hopper 62 is provided with a conventional swing ring 63 to provide a rotational movement for the discharge chute mechanism 60 about the center of the receiving hopper 62. The swing ring 63 provides a range of operation of the discharge chute mechanism 60 along a generally horizontal arc extending significantly greater than 180°, as indicated by the arrow 64 in FIG. 2 and the phantom position of the discharge chute mechanism 50. A conventional hydraulic cylinder 65 interconnecting the vehicle 10 and the discharge chute mechanism 60 controls the vertical orientation of the discharge chute mechanism 60 throughout the entire range of operation 64.

The discharge chute mechanism 60 is preferably a telescopic, three section discharge chute mechanism 60 that is extensive through the operation of a hydraulic cylinder (not shown). The details of the construction and operation of the telescopic discharge chute mechanism 60 are disclosed in copending U.S. patent application Ser. No. 08/413,383, filed on Mar. 30, 1995, and entitled "Discharge Chute Apparatus for Concrete Trucks" the descriptive portions of which are incorporated herein by reference.

Similar to the discharge chute mechanism 60, the mixing auger apparatus 20 is also pivotally connected at the pivot 59 to the receiving ring 16 to permit vertical movement of the mixing auger throughout the range of operation 19 thereof, as depicted in phantom in FIG. 1. A hydraulic cylinder 58 interconnecting the top of the vehicle 10 and the subframe 29 of the mixing auger apparatus 20 controls the angle of repose of the mixing auger apparatus 20 when not in the normal operative position discharging concrete mixture into the discharge chute mechanism 60. To insure that the individual component materials enter the infeed opening 21 of the mixing auger apparatus 20 when the mixing auger apparatus is lowered below the normal operative position, the infeed opening is provided with an upwardly extending angled hopper 21*a* that is engaged against the receiving ring shroud 17 when in the normal operative position, as best seen in FIG. 1.

Accordingly, the combination of a freely movable mixing auger apparatus 20 throughout the first range of operation 19 thereof and a rotatable, telescopible discharge chute mechanism 60 movable throughout the second range of operation 64 thereof, which overlaps the first range of operation 19 due to the mounting of the receiving hopper for the discharge chute mechanism 60 at the lateral front corner of the vehicle 10, provides a concrete production machine capable of a versatile discharge of concrete mixture to a great number of locations without requiring the movement of the vehicle 10 to move the discharge point from one location to another.

Typically, the operator will be able to control the amount of concrete mixture being produced and the location of the discharge thereof to the desired place at the job site from within the operator's cab 10*a* of the vehicle 10. Normal operation will result in the mixing of concrete within the mixing auger apparatus 20 for discharge into the discharge chute mechanism 60 to be deposited at the desired location forwardly of the vehicle operator's cab 10*a*. With the location of remote controls for all of the hydraulically and electrically operated functions of the vehicle 10, the operator never needs to leave his cab 10*a* to view and control the discharge of concrete mixture substantially anywhere along the second range of operation 64. Other control devices (not shown) mounted on the exterior of the vehicle 10 will enable the operator to control the production and discharge of concrete mixture from both the mixing auger apparatus 20 and the discharge chute mechanism 60.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. A mixing auger apparatus for use in combining a plurality of material components to create a mixture, at least one of said component materials including chunks, comprising:

a mixing auger having an elongated central shaft and spiral flighting affixed thereto, said shaft being mounted for rotation and having an inlet end and a discharge end;

a flexible housing circumferentially surrounding said mixing auger and defining a chamber cooperable with said flighting to permit said flighting to convey said materials from said inlet end to said discharge end upon rotation of said shaft, said flexible housing being operable to flex radially relative to said shaft to prevent said material chunks from wedging between said flighting and said housing, said housing defining an inlet opening corresponding to said inlet end of said mixing auger to permit the introduction of said component materials to said inlet end and a discharge opening corresponding to said discharge end of said mixing auger to permit said mixture to be discharged from said discharge end; and means for rotating said central shaft.

2. The mixing auger apparatus of claim 1 wherein said flexible housing further includes a frame surrounding said mixing auger and elastomeric material attached to said frame to form said chamber.

3. The mixing auger apparatus of claim 2 wherein said elastomeric material is suspended from said frame by elastomeric supports so that said chamber can be radially flexible around the entire circumference thereof.

4. The mixing auger apparatus of claim 3 wherein said frame includes a hinged portion to permit a portion of said chamber to be moved outwardly from an operative position to an inoperative position away from said mixing auger to facilitate the cleaning of said chamber.

5. The mixing auger apparatus of claim 4 wherein said flexible housing is formed from a sheet of elastomeric material having first edge supported from a first rigid support member, a body portion wrapped around the circumference of said mixing auger, and a distal second edge yieldably connected to a movable support member to be positioned against said body portion below the connection of said first edge to said first rigid support member, said body portion being suspended from a second rigid support member by an elastomeric support interconnecting said body portion and said second rigid support member.

6. The mixing auger apparatus of claim 4 wherein said flexible housing is supported from an adjustment mechanism selectively operable to vary a clearance between said flexible housing and said mixing auger.

7. The mixing auger apparatus of claim 6 wherein said adjustment mechanism includes a first adjustable mechanism operably associated with said first edge of said flexible housing and a second adjustable mechanism operably associated with said second edge.

8. The mixing auger apparatus of claim 7 wherein said first adjustment mechanism includes a bracket connected to said first edge and being movably supported from said sub-frame by a threaded support to effect selective movement of said first edge relative to said sub-frame, said second adjustment mechanism including a threaded member supporting said second edge and being movable along a support member pivotally connected to said sub-frame to permit said second edge to be moved away from said mixing auger to open said chamber and expose said mixing auger, the relative movement between said threaded member and said support member providing a positional adjustment of said second edge relative to said mixing auger.

9. The mixing auger apparatus of claim 8 further comprising a latching means interconnecting said first and second rigid support members to capture said movable support member in an operative position with said second edge being positioned adjacent said body portion to form said chamber around said mixing auger.

10. In a mixer apparatus for use in combining preselected quantities of component materials to create a concrete mixture, said mixer apparatus including a mixing auger having a central shaft and spiral flighting affixed thereto, said shaft being mounted for rotation and having an inlet end and a discharge end; and means for rotating said central shaft, the improvement comprising:

a flexible housing circumferentially surrounding said mixing auger and defining a chamber cooperable with said flighting to permit said flighting to convey said materials from said inlet end to said discharge end upon rotation of said shaft, said flexible housing being operable to flex radially around substantially the entire circumference of said chamber relative to said shaft to prevent said material chunks from wedging between said flighting and said housing, said housing defining an inlet opening corresponding to said inlet end of said mixing auger to permit the introduction of said component materials to said inlet end and a discharge opening corresponding to said discharge end of said mixing auger to permit said mixture to be discharged from said discharge end.

11. The mixer apparatus of claim 10 wherein said flexible housing further includes a frame surrounding said mixing auger and elastomeric material attached to said frame to form said chamber, said elastomeric material being suspended from said frame by elastomeric supports so that said chamber can be radially flexible around substantially the entire circumference thereof, said frame including a hinged portion to permit a portion of said chamber to be moved outwardly from an operative position to an inoperative position away from said mixing auger to facilitate the cleaning of said chamber.

12. The mixer apparatus of claim 11 wherein said flexible housing is formed from a sheet of elastomeric material having first edge fixed to a first rigid support member, a body portion wrapped around the circumference of said mixing auger, and a distal second edge yieldably connected to a movable support member through a first of said elastomeric supports to be positioned against said body portion below the connection of said first edge to said first rigid support member, said body portion being suspended from a second rigid support member by a second elastomeric support interconnecting said body portion and said second rigid support member.

13. The mixer apparatus of claim 12 wherein said flexible housing is supported from an adjustment mechanism selectively operable to vary a clearance between said flexible housing and said mixing auger, said adjustment mechanism including a first adjustable mechanism operably associated with said first edge of said flexible housing and a second adjustable mechanism operably associated with said second edge.

14. The mixer apparatus of claim 13 wherein said mixer apparatus is oriented in a first operative position with said inlet opening located at a lower position to receive said component materials from a conveyor system and with said discharge opening located at an elevated position to discharge said concrete mixture into a chute mechanism, said mixing auger apparatus being disposed in said first operative position at an angle of inclination greater than 22 degrees as measured from horizontal.

15. In a mobile concrete mixer operable to transport component materials in separate hoppers to a job site where preselected quantities of said component materials, including aggregate, are mixed to create a predetermined amount of concrete mixture, said concrete mixer including a conveying mechanism operable to deliver said preselected quantities of said component materials from the respective hoppers to a mixing auger apparatus having a mixing auger operable to create said concrete mixture from said preselected quantities of said component materials for discharge therefrom at a discharge end, and a flexible housing supported from a sub-frame and being operably associated with said mixing auger to permit said mixing auger to convey said concrete mixture to said discharge end, the improvement comprising:

adjustment means operably supporting said flexible housing from said sub-frame for positionally adjusting said housing relative to said mixing auger to maintain a predetermined clearance therebetween.

16. The mobile concrete mixer of claim 15 wherein said flexible housing has a first longitudinal edge and a second longitudinal edge positioned adjacent said first edge such that said flexible housing circumferentially surrounds said mixing auger and defines a chamber cooperable with said flighting to permit said flighting to convey said materials from said inlet end to said discharge end upon rotation of said shaft, said flexible housing being operable to flex radially around substantially the entire circumference of said chamber relative to said shaft to prevent said material chunks from wedging between said flighting and said housing, said sub-frame surrounding said mixing auger and having said flexible housing attached thereto to form said chamber, said flexible housing being suspended from said sub-frame by elastomeric supports so that said chamber can be radially flexible around substantially the entire circumference thereof.

17. The mobile concrete mixer of claim 16 wherein said adjustment means includes a first adjustable mechanism operably associated with said first edge of said flexible housing and a second adjustable mechanism operably associated with said second edge.

18. The mobile concrete mixer of claim 17 wherein said first adjustment mechanism includes a bracket connected to said first edge and being movably supported from said sub-frame by a threaded support to effect selective movement of said first edge relative to said sub-frame.

19. The mobile concrete mixer of claim 18 wherein said second adjustment mechanism includes a threaded member supporting said second edge and being movable along a support member pivotally connected to said sub-frame to permit said second edge to be moved away from said mixing auger to open said chamber and expose said mixing auger, the relative movement between said threaded member and said support member providing a positional adjustment of said second edge relative to said mixing auger.

20. The mobile concrete mixer of claim 19 wherein said support member is pivotally secured relative to said sub-frame by a latching device, said latching device having an adjustable stop therein to define the pivoted orientation of said support member when secured by said latching device, the selected pivoted orientation of said support member effecting a positional adjustment of said second edge of said flexible housing relative to said mixing auger.

* * * * *